US012667186B2

(12) United States Patent
Williamson

(10) Patent No.: US 12,667,186 B2
(45) Date of Patent: Jun. 30, 2026

(54) FOLDABLE DOUBLE EASEL

(71) Applicant: James Thomas Williamson, Brooklyn, NY (US)

(72) Inventor: James Thomas Williamson, Brooklyn, NY (US)

( * ) Notice: Subject to any disclaimer, the term of this patent is extended or adjusted under 35 U.S.C. 154(b) by 0 days.

(21) Appl. No.: 18/806,490

(22) Filed: Aug. 15, 2024

(65) Prior Publication Data

US 2026/0047676 A1 Feb. 19, 2026

(51) Int. Cl.
*A47B 23/04* (2006.01)
*A47B 97/08* (2006.01)

(52) U.S. Cl.
CPC ..... *A47B 23/043* (2013.01); *A47B 23/042* (2013.01); *A47B 23/044* (2013.01); *A47B 97/08* (2013.01)

(58) Field of Classification Search
CPC ... A47B 23/043; A47B 23/042; A47B 23/044; A47B 97/08
USPC ..... 248/459
See application file for complete search history.

(56) References Cited

U.S. PATENT DOCUMENTS 70,339 A * 10/1867 Kreitz ..... A47B 19/06 108/9
218,893 A * 8/1879 McIlvenna et al. ... A47B 97/08 312/231
681,976 A * 9/1901 Rathvon ..... A47B 23/043 248/456
1,180,057 A * 4/1916 McNamara ..... A47B 23/043 43/115
1,225,642 A * 5/1917 Jones ..... A47B 97/08 248/449
2,012,551 A * 8/1935 Steen ..... A47B 23/043 248/463
2,091,260 A * 8/1937 Farkas ..... G09F 1/00 283/56
2,165,255 A * 7/1939 Hamilton ..... A47B 23/043 248/455
2,224,530 A * 12/1940 Weinstein ..... A47B 23/043 248/456

(Continued)

FOREIGN PATENT DOCUMENTS

FR 2786729 A1 * 6/2000 ..... B42F 7/04
GB 2448234 A * 10/2008 ..... G09F 1/06

(Continued)

OTHER PUBLICATIONS

[202D] Nice Book Stand Bible Wooden Reading Holder Desk bookstands Cookbook, webpage, (full link provided on separate sheet). last accessed Aug. 15, 2024.

(Continued)

*Primary Examiner* — Taylor Morris
(74) *Attorney, Agent, or Firm* — Troutman Pepper Locke, LLP

(57) ABSTRACT

A foldable easel includes a first media panel hingedly connected to a second media panel which is hingedly connected to a third panel laying horizontally along a flat surface. A first support, second support, and locking panel help support the first and second media panel to be erected in a viewing fashion. At least two items may be displayed on the first and second media panels while erected and the easel may be folded into a compact unit when in a state of non-use.

19 Claims, 14 Drawing Sheets

(56) References Cited

U.S. PATENT DOCUMENTS 2,472,166 A * 6/1949 Mathewson ..... G09F 1/06 229/92.8
2,722,434 A * 11/1955 Wolfe ..... B42F 13/402 248/460
2,726,835 A * 12/1955 Hummel ..... A47F 5/112 248/459
2,902,785 A * 9/1959 Nichols ..... G09F 1/14 40/120
3,119,194 A * 1/1964 Ray ..... A47B 23/044 248/459
3,195,850 A * 7/1965 Steiner ..... A47B 23/043 248/459
3,305,206 A * 2/1967 Nichols ..... A47B 23/043 248/459
3,380,701 A * 4/1968 Byars ..... A47B 23/044 248/459
3,410,516 A * 11/1968 Criswell ..... A47B 23/044 248/463
3,450,420 A * 6/1969 Smith ..... B42F 13/402 281/33
3,580,536 A * 5/1971 Nichols ..... A47B 23/044 248/459
3,738,604 A * 6/1973 Howlett ..... A47B 97/08 248/459
3,785,605 A * 1/1974 Parekh ..... A47B 23/044 248/455
4,105,182 A * 8/1978 Jacobson ..... B42F 13/402 248/459
4,143,847 A * 3/1979 Cross ..... A47B 19/08 248/459
4,400,161 A * 8/1983 Gerlt ..... G09B 19/0023 402/72
4,522,364 A * 6/1985 Charney ..... A47B 19/08 248/460
4,886,231 A * 12/1989 Doerksen ..... A47B 23/043 248/205.2
5,253,840 A 10/1993 Sherametta
5,413,305 A * 5/1995 Leeb ..... A47B 23/043 248/459
5,480,118 A * 1/1996 Cross ..... G09F 1/12 248/459
5,722,628 A * 3/1998 Menaged ..... A47B 23/043 248/455
5,809,673 A * 9/1998 Johnson ..... G09F 1/06 40/124.08
6,010,158 A * 1/2000 Croteau ..... A47B 23/044 248/456
6,270,049 B1 * 8/2001 Olvey ..... A47B 96/202 248/447
6,648,293 B1 * 11/2003 Sachnoff ..... G09F 1/10 248/460
7,243,893 B2 * 7/2007 Sobue ..... A61M 1/287 248/459
7,364,129 B1 * 4/2008 Levari, Jr. ..... A47G 23/0216 108/4
9,249,922 B2 * 2/2016 Haarburger ..... A47B 23/042
11,297,941 B1 * 4/2022 Hadar ..... A47B 23/043
11,540,625 B1 * 1/2023 Soho ..... A45C 11/34
2006/0081758 A1 * 4/2006 Lee ..... A47B 97/08 248/459
2007/0194201 A1 * 8/2007 Dempsey ..... A47F 7/14 248/459
2008/0230672 A1 * 9/2008 Pachowski ..... A47B 23/044 248/459
2016/0059620 A1 * 3/2016 Vecchio ..... B44D 3/18 38/102.9
2016/0338487 A1 * 11/2016 McGrane ..... F16M 13/00
2023/0200529 A1 * 6/2023 Vlaar ..... A47B 21/0314 248/371
2024/0183487 A1 * 6/2024 Wu ..... G06F 1/1616

FOREIGN PATENT DOCUMENTS

GB 2458737 A * 10/2009 ..... F16M 13/00
JP 3165771 U 2/2011
KR 200313994 Y1 * 5/2003 ..... A47B 13/02
KR 20080001823 U * 6/2008 ..... A47B 23/043
KR 200442167 Y1 * 10/2008 ..... A47B 23/043
KR 100875119 B1 * 12/2008 ..... A47B 23/043
KR 101245866 B1 * 3/2013 ..... A47B 23/00
KR 102366960 B1 * 2/2022 ..... A47B 23/044
KR 20230001028 U * 5/2023 ..... A47B 23/043
KR 20230105950 A * 7/2023 ..... A47B 23/043
NL 1023732 C2 * 1/2004 ..... A47B 23/043

OTHER PUBLICATIONS

Bookstand-Tiltable-Tablet-Laptop-Accessory, webpage, (full link provided on separate sheet). last accessed Aug. 15, 2024.
ZXMOTO-Double-Layer-Adjustable-Hands-Free-Bookstand, webpage, (full link provided on separate sheet). last accessed Aug. 15, 2024.
KABCON-Adjustable-Foldabele-Eye-Level-Etc-Silver, webpage, (full link provided on separate sheet). last accessed Aug. 15, 2024.

* cited by examiner

FOLDABLE DOUBLE EASEL

TECHNICAL FIELD

The present disclosure relates generally to easels or workstations, and more particularly to foldable easels or workstations, e.g., foldable easels or workstations permitting a user to work on and/or visualize at least two forms of content at the same time.

BACKGROUND

Easels provide upright support used for displaying and/or fixing something resting upon it. As laptops and tablets become more ubiquitous, easels are becoming more specialized to accommodate such technology. Current easels or workstations do not always provide a means to view forms of media or content at a single time, and if they do, such workstations are often large, bulky, and inconvenient to travel with.

Accordingly, conventional easels and workstations do not provide full functionality for users wishing to have multiple separate viewing areas in one compact product that folds up for easy storage. Thus, there is an ever-present need for improved systems for individuals to be able to increase their productivity. This disclosure provides a solution for this need allowing for multiple forms of content to be visualized and worked on at the same time.

SUMMARY

In accordance with at least one aspect of this disclosure, a foldable easel can be configured to move between a folded state and an erected state. The easel has a first panel configured to stand in a first plane in an erected state and may be configured to support a first item. A second panel can be hingedly connected to the first panel configured to stand in a second plane different from the first plane in the erected state and may be configured to support a second item. A third panel can be hingedly connected to the second panel and may be configured to stand in a third plane in the erected state. The third plane can be different from the first plane and the second plane. The third panel can be configured to lay flat on a horizontal surface in the erected state. In an erected state, the second panel may be angled less than 90 degrees relative to the third panel, and the first panel may be angled greater than 90 degrees relative to the second panel. In a folded state, the first panel, the second panel, and the third panel may all be parallel.

In certain embodiments a first support panel can be hingedly connected to the first panel and a locking panel can be hingedly connected to the first support panel. The first support panel can be configured to stand in a fourth plane in the erected state and the locking panel can be configured to stand in a fifth plane in the erected state. In the erected state, the locking panel can be configured to lock the first panel in the first plane supported by the first support panel.

In certain embodiments a second support panel can be hingedly connected to the third panel and the second support panel can be configured to stand in a sixth plane in the erected state. In the erected state, the second support panel can be configured to interact with the locking panel and the second panel to lock the second panel in the second plane wherein it is supported by the second support panel.

In certain embodiments the second panel further includes a first locking aperture configured to receive a locking flap of the locking panel in the erected state and a second locking aperture configured to receive a first locking tab of the second support panel in the erected state.

In certain embodiments the second support panel further includes a first locking aperture configured to receive a first locking tab of the locking panel in the erected state.

In certain embodiments the second support panel further includes a second locking aperture configured to receive a second locking tab of the locking panel in the erected state.

In certain embodiments the second panel further includes a first thickened portion adjacent to the first panel in the erected state and a second thickened portion adjacent to the third panel in the erected state. The first and second thickened portions can be configured to retain the second item therebetween when the second item is placed on the second panel in the erected state.

In certain embodiments the first locking aperture of the second panel can be defined in the first thickened portion such that in the erected state, the locking flap of the locking panel extends through the first locking aperture, through the first thickened portion, and extends out beyond the first thickened portion to create a ledge. The second locking aperture of the second panel can be defined below the first thickened portion such that in the erected state, the first locking tab of the second support panel extends through the second locking aperture and along the first thickened portion.

In certain embodiments the locking flap can be configured to extend through the first thickened portion generally horizontally such that the locking flap supports the first item thereon.

In certain embodiments, when folded, the first panel, the second panel, the third panel, the first support panel, the locking panel, and the second support panel lie parallel to one another.

In certain embodiments the first item can be a viewing screen configured to rest on the first locking flap in the erected state, and the second item can be a graphics tablet configured to be held on the second panel between the first thickened portion and the second thickened portion to restrict up and down movement of the graphics tablet.

In certain embodiments either the first thickened portion and/or the second thickened portion of the second panel can further include a bore for receiving a third item, wherein the third item can be a pen or stylus.

In certain embodiments the first item can be a book, configured to hang over a hinge between the first panel and the first support panel. The second item can be a writing pad configured to be held on the second panel between the first thickened portion and the second thickened portion to restrict up and down movement of the writing pad.

In certain embodiments the second item can be a spiral notebook. The second panel can further include a plurality of apertures configured to receive a spiral binding of the spiralized notebook such that the spiral notebook can be configured to lay flat on the second panel.

In certain embodiments at least one of the first thickened portion and/or the second thickened portion of the second panel can further include a bore for receiving a third item, wherein the third item can be a pen or stylus.

In accordance with at least one aspect of this disclosure, a double easel includes a first panel standing in a first viewing plane, a second panel hingedly connected to the first panel and standing in a second viewing plane different from the first plane, and a third panel hingedly connected to the second panel and standing in a third plane. The third plane can be in a different plane from the first plane and the second plane. In a state of use, the third panel can be configured to lay flat on a horizontal surface, and the second panel can be angled less than 90 degrees relative to the third panel, and the first panel can be angled greater than 90 degrees relative to the second panel. In a state of non-use the first panel, the second panel, and the third panel may fold together to be parallel to one another.

In certain embodiment a first support panel can be hingedly connected to the first panel and a locking panel can be hingedly connected to the first support panel. The first support panel lies in a fourth plane and the locking panel lies in a fifth plane. The locking panel includes one or more locking features configured to lock the first panel in the first plane wherein it may be supported by the first support panel.

In certain embodiments a second support panel can be hingedly connected to the third panel. The second support panel lies in a sixth plane, wherein, the second support panel can be configured to interact with the locking panel and the second panel to lock the second panel in the second plane supported by the second support panel.

In certain embodiments the foldable easel includes one or more locking features including a first locking aperture and a second locking aperture of the second panel and a first locking aperture and a second locking aperture of the second support panel.

In accordance with at least one aspect of this disclosure, a blank for forming a foldable easel has a locking panel, a first support panel hingedly connected to the locking panel at a first fold line, and a first media panel hingedly connected to the first support panel at a second fold line opposite the first fold line across the first support panel. When set up, the first media panel can be configured to support a first medium. A second media panel can be hingedly connected to the first panel at a third fold line opposite the second fold line across the first media panel including a first and second thickened portion with at least one bore. When set up, the second media panel can be configured to support a second medium.

A third panel can be hingedly connected to the second panel at a fourth fold line, opposite the third fold line across the second media panel, and a second support panel can be hingedly connected to the third panel at a fifth fold line, opposite the fourth fold line across the third panel. When the easel is set up, the third panel can be configured to lay flat on a horizontal surface, the second media panel can be configured to fold upward and away from the third panel to form a first viewing plane, and the second support panel can be configured to fold upward and away from the third panel to meet the second media panel.

A locking tab portion of the second support panel can be configured to insert into the second media panel to lock the second media panel in the first viewing plane, the first media panel can be configured to fold relative to the second media panel to stand generally vertically relative to the horizontal to form a second viewing plane, the first support panel can be configured to fold downward, away from the first media panel and towards the third panel, and the locking panel can be configured to fold relative to the first support panel inwards towards the third panel.

A first portion of the locking panel can be configured to insert into the second support panel to lock the first support panel and the first media panel into place. A second portion of the locking panel can be configured to insert into the first media panel to lock the first media panel into place and further support the first medium on the first media panel. When the easel is folded, the locking panel, the first support panel, the first media panel, the second media panel, the third panel, and the second support panel may be configured to lay flat and stack atop one another.

BRIEF DESCRIPTION OF THE DRAWINGS

So that those skilled in the art to which the subject disclosure appertains will readily understand how to make and use the devices and methods of the subject disclosure without undue experimentation, other embodiments thereof will be described in detail herein below with reference to certain figures, wherein.

DETAILED DESCRIPTION

Figure 1:
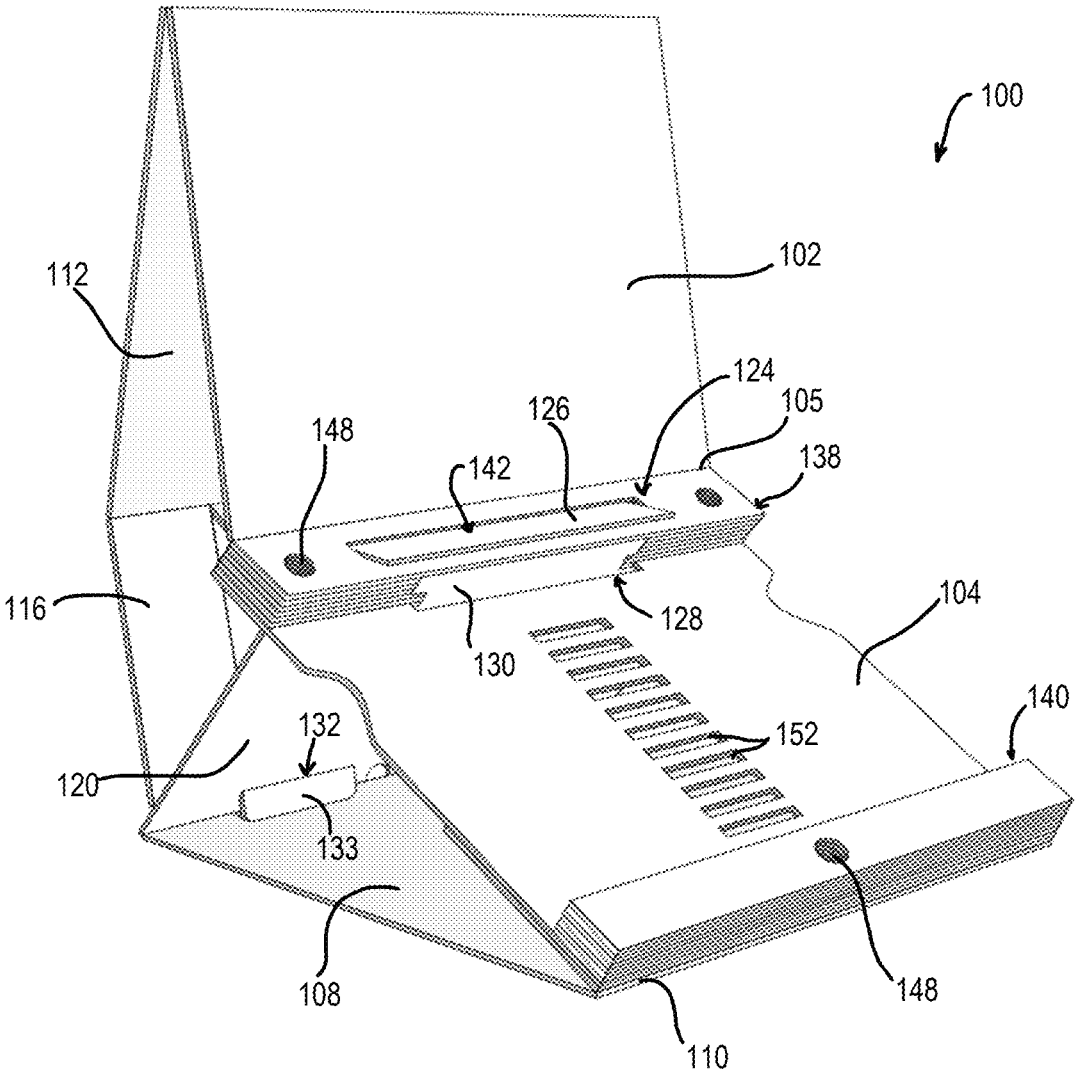
FIG. 1 is a front perspective view of an embodiment of a foldable easel in accordance with this disclosure, showing the easel in an erected state.

Reference will now be made to the drawings wherein like reference numerals identify similar structural features or aspects of the subject disclosure. For purposes of explanation and illustration, and not limitation, an illustrative view of an embodiment of a foldable double easel in accordance with the disclosure is shown in FIG. 1 and is designated generally by reference character 100. Other embodiments and/or aspects of this disclosure are shown in FIGS. 2-18.

Figure 11:
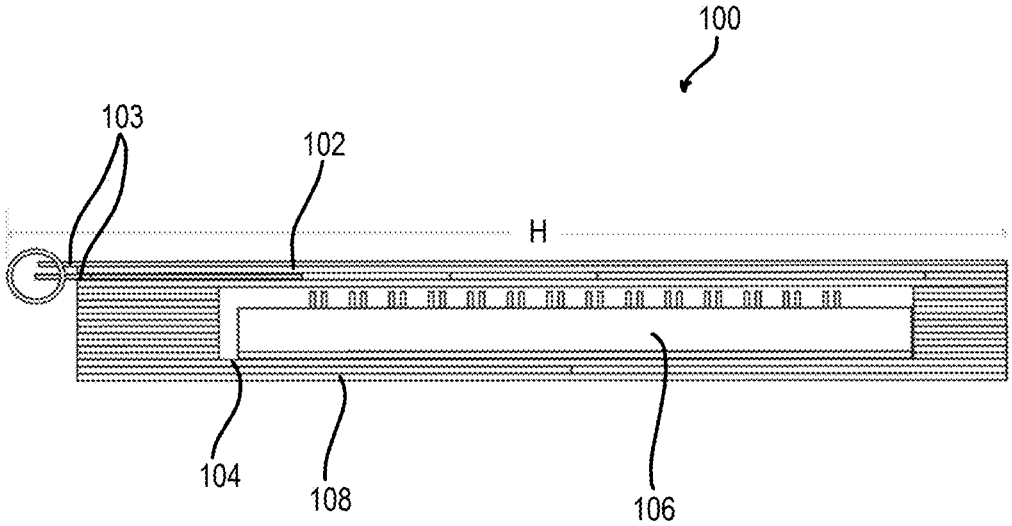
FIG. 11 is a side elevation view of the foldable easel of FIG. 9 shown in the folded state.
Figure 12:
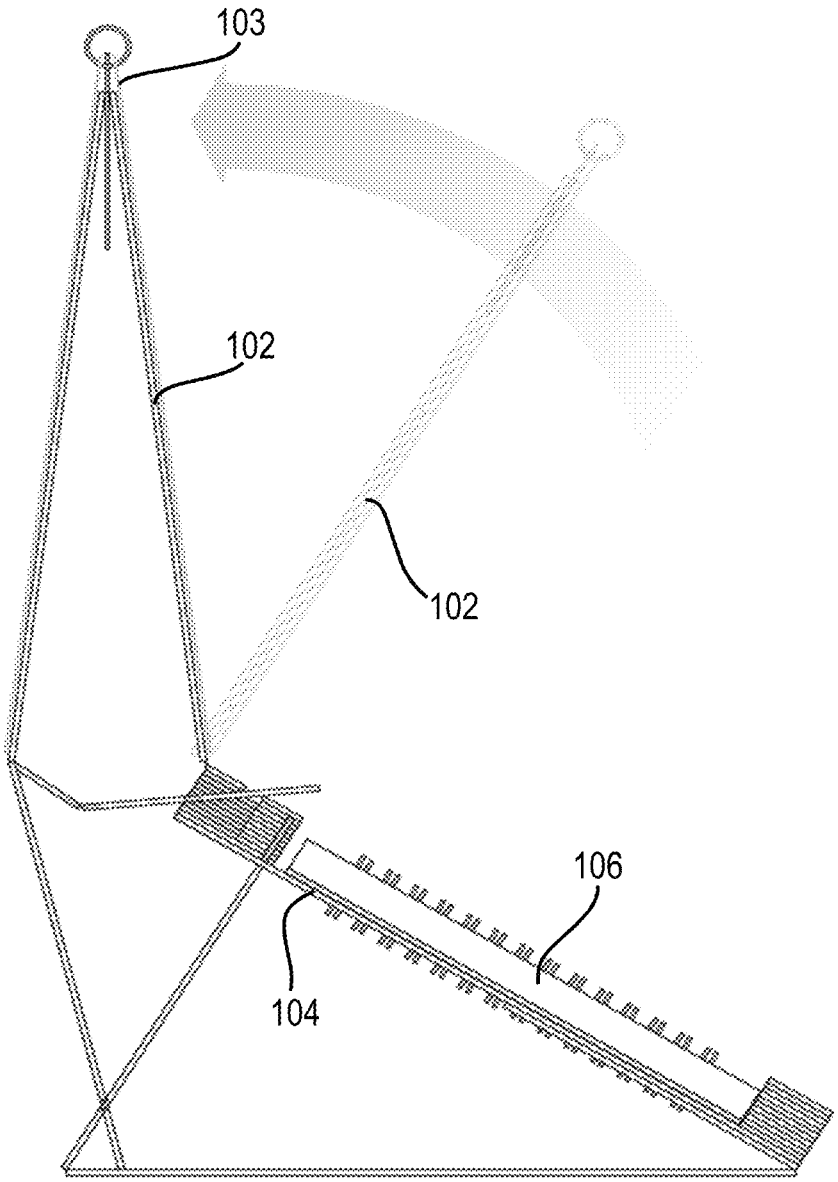
FIG. 12 is a side elevation view of the foldable easel of FIG. 9, showing movement of the first panel from the folded state to the erected state.

In accordance with at least one aspect of this disclosure, as shown in FIGS. 1-12, a foldable easel 100 is configured to move between a folded state (e.g., as shown in FIG. 11) and an erected state (e.g., as shown in FIGS. 1-10, where FIG. 12 shows motion from the folded state to the erected state). The foldable easel 100, when in the erected state is configured and adapted to provide a user with multiple viewing platforms for viewing and/or using different forms of media at the same time. FIGS. 1-8 show an embodiment of the foldable easel 100 where there are no media supported on the easel, while FIGS. 9-12 show the foldable easel 100 supporting a first and second item.

Figure 2:
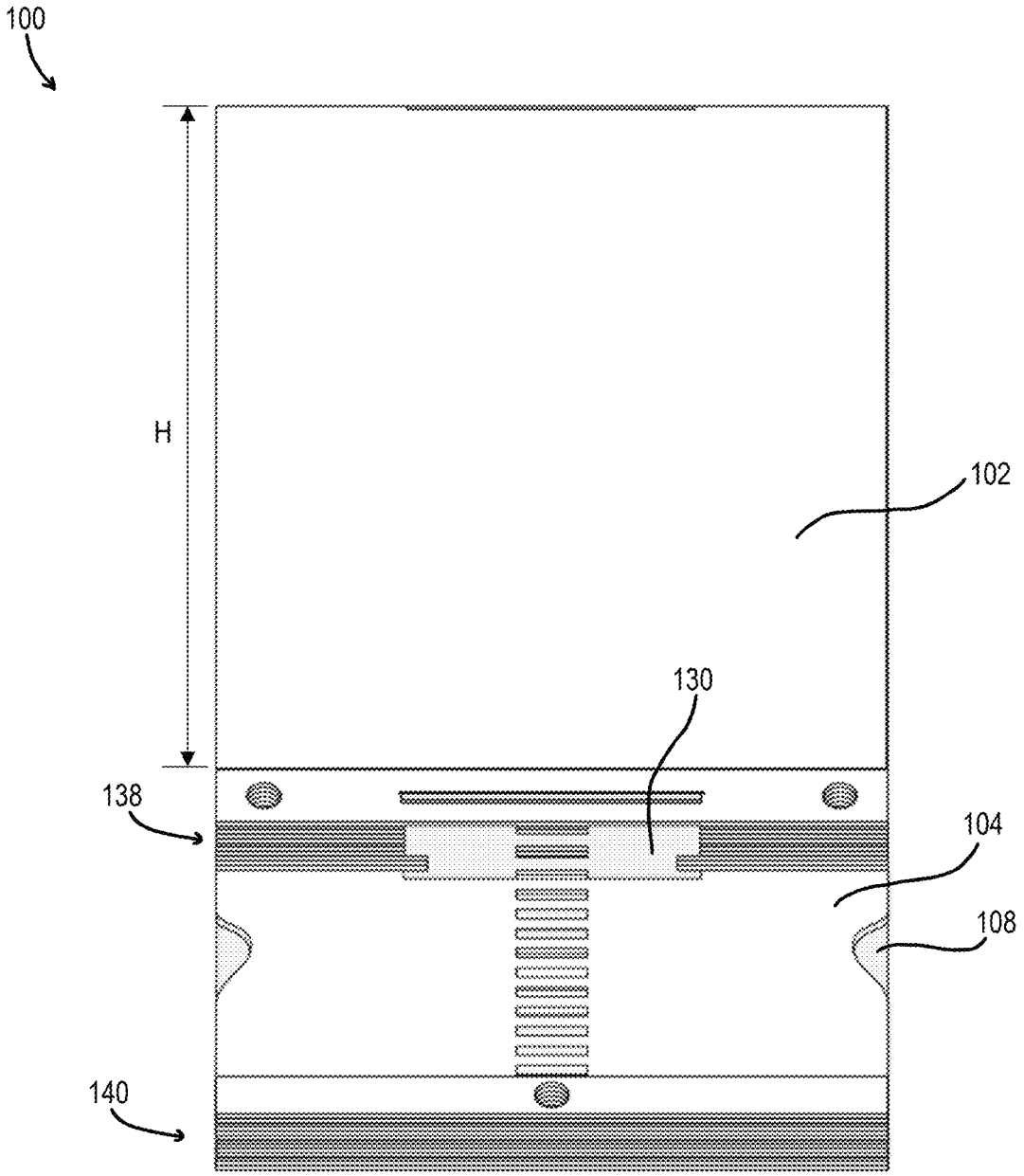
FIG. 2 is a front view of the foldable easel of FIG. 1.
Figure 9:
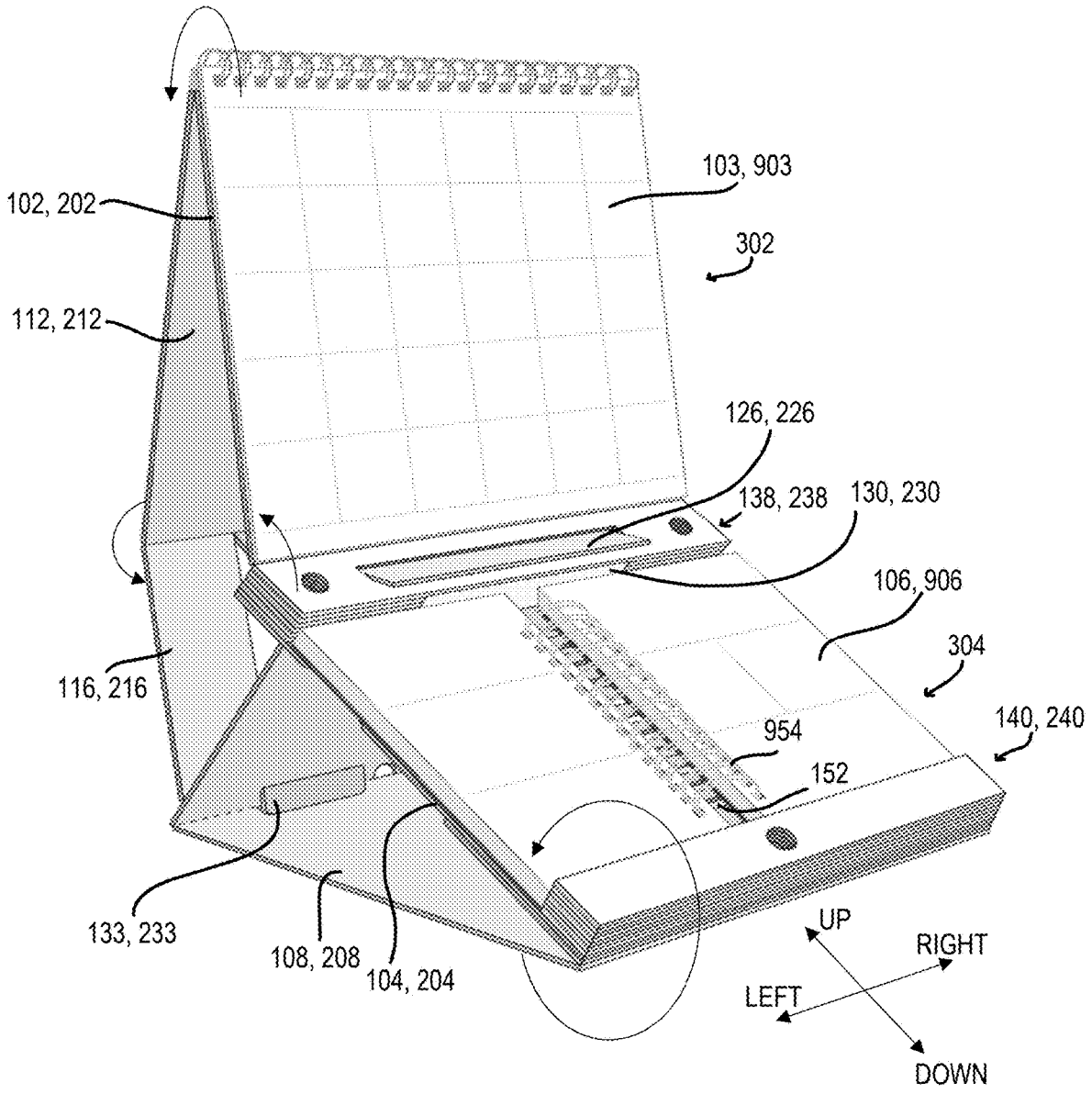
FIG. 9 is a front perspective view of the foldable easel of FIG. 1, showing the foldable easel in the erected state having a first item supported by the first panel and a second item supported by the second panel.
Figure 10:
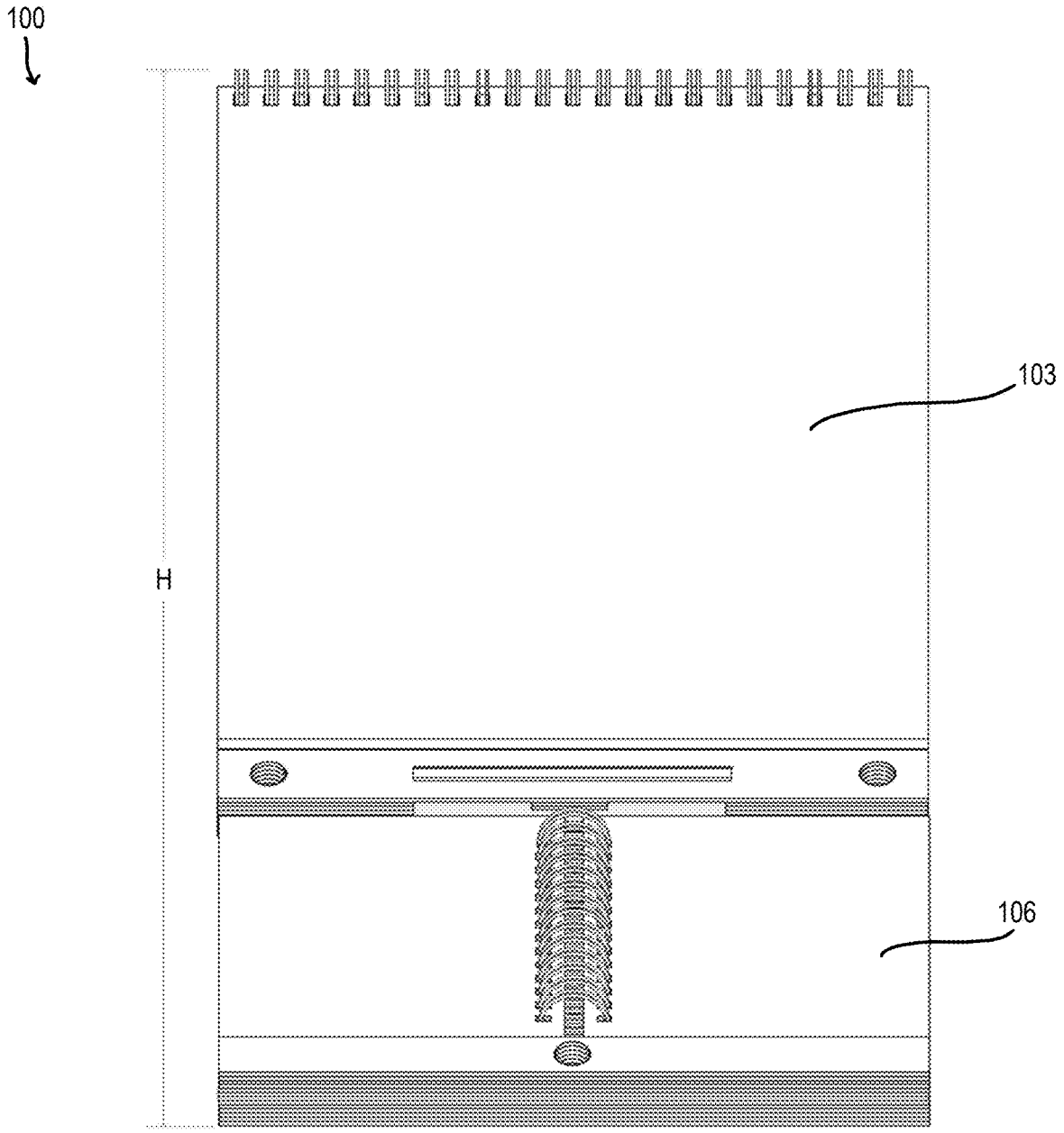
FIG. 10 is a front elevation view of the foldable easel of FIG. 9.

With reference to FIGS. 1 and 9, the foldable easel 100 includes a first panel 102 configured to stand in a first plane in the erected state and configured to support a first item 103 (e.g., a first form of media). A second panel 104 can be hingedly connected to the first panel 102 (e.g., via hinge 105) configured to stand in a second plane different from the first plane in the erected state. In the erected state, the second panel 104 is configured to support a second item 106 (e.g., a second form of media). In certain embodiments, as shown in FIG. 2 for example, the first panel 102 can have a height H greater than a height of the second panel 104. In certain embodiments, the height of the first panel 102 and the second panel 104 can be the same.

Figure 3:
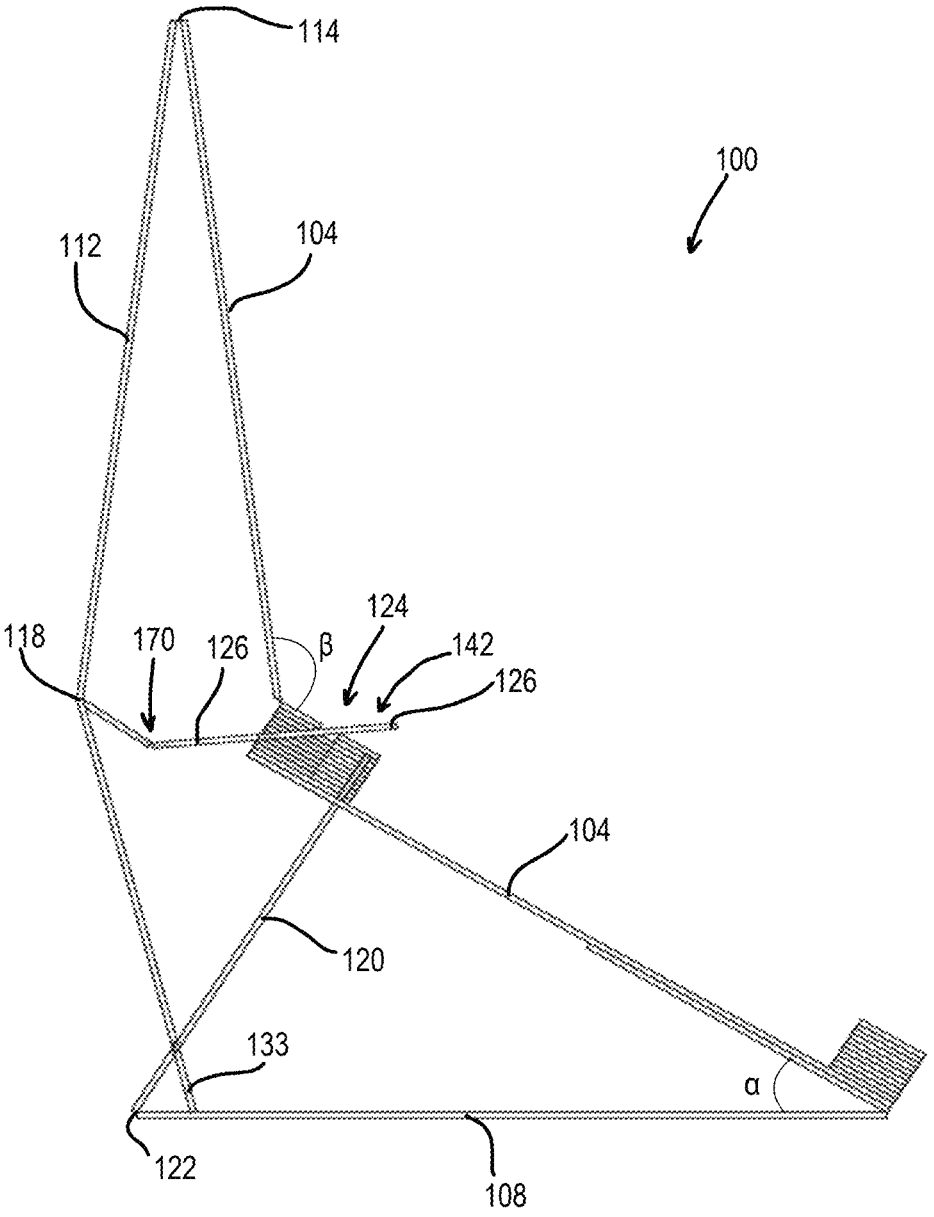
FIG. 3 is a left side view of the foldable easel of FIG. 1.

A third panel 108 can be hingedly connected to the second panel 104 (e.g., via hinge 110), configured to stand in a third plane in the erected state. The third plane may be different plane from the first plane and the second plane, e.g., as shown. The third panel 108 can be configured to lay flat on a horizontal surface in the erected state (e.g., as shown in FIGS. 1 and 3). As best seen in FIG. 3, in the erected state, the second panel 104 is angled relative to the third panel 108 by angle $\alpha$. In certain embodiments, the angle $\alpha$ may be less than 90 degrees. The first panel 102 is angled relative to the second panel 104 by an angle $\beta$. In certain embodiments, the angle $\beta$ may be greater than 90 degrees. As shown in FIG. 11, in the folded state, all panels, including the first panel 102, the second panel 104, and the third panel 108 all be parallel relative to one another, even if the first item 103 and second item 106 remain on the first and second panels in the folded state.

Figure 4:
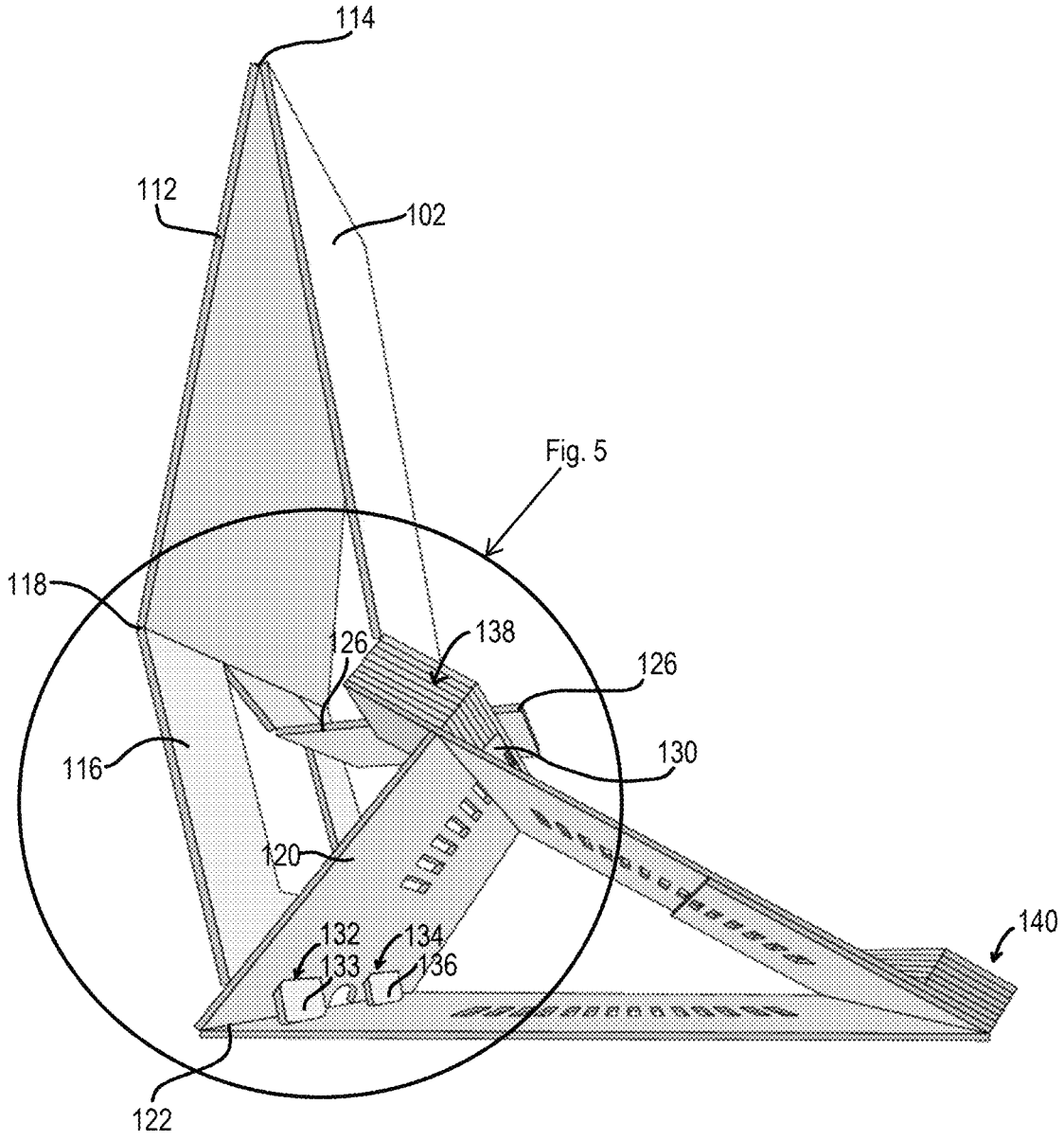
FIG. 4 is left side perspective view of the foldable easel of FIG. 1.
Figure 5:
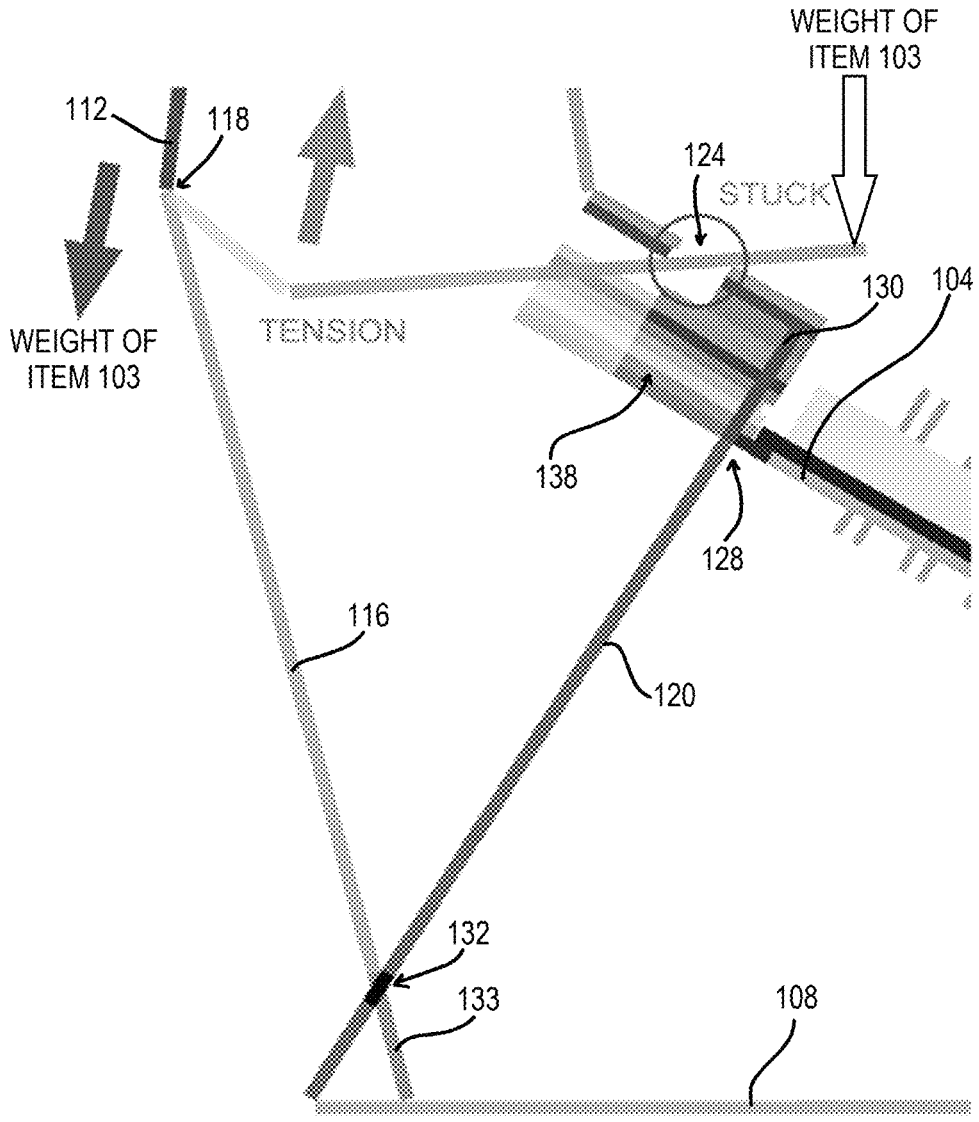
FIG. 5 an enlarged partial view of the foldable easel of FIG. 4, showing a weight distribution though the respective panels of the foldable easel.
Figure 6:
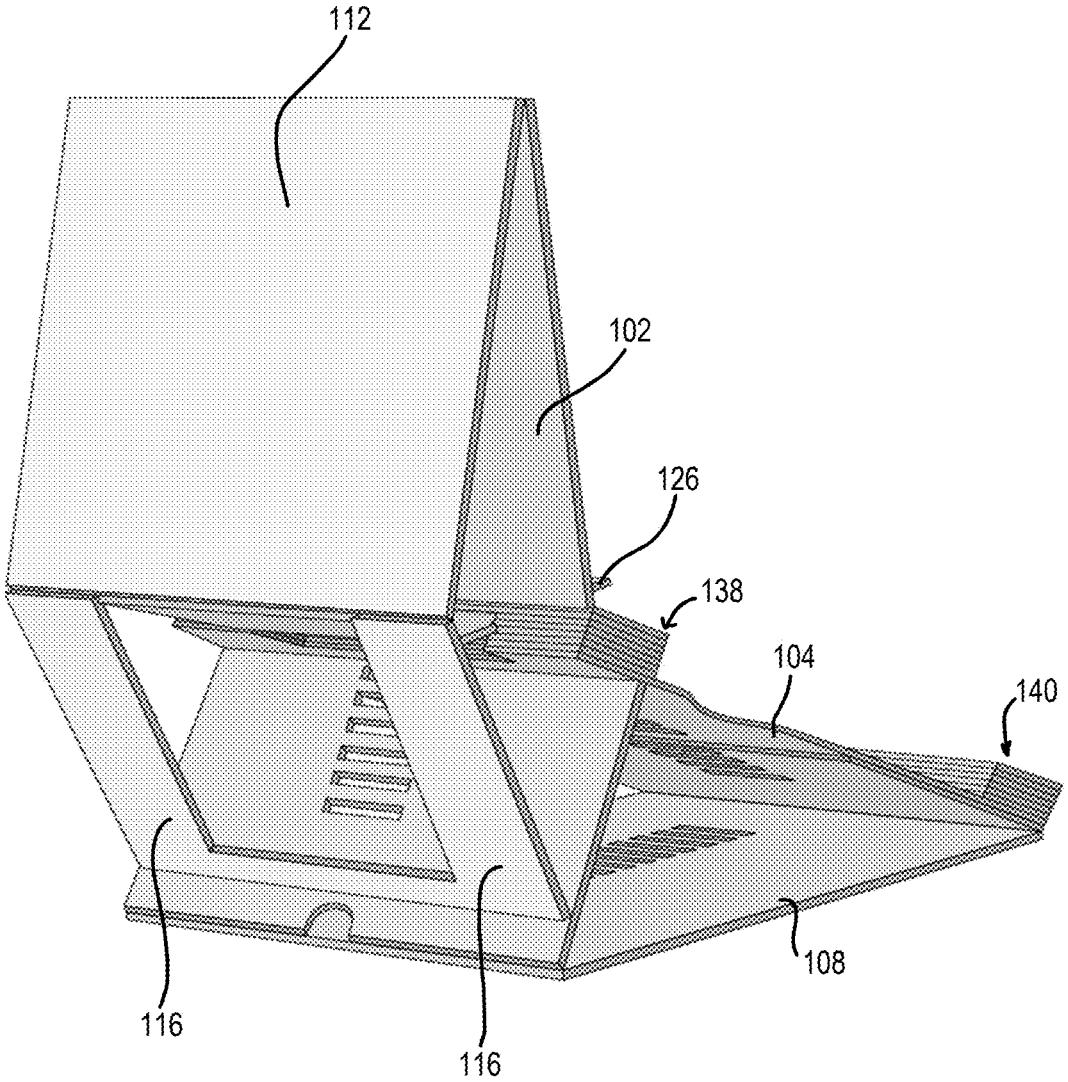
FIG. 6 is rear perspective view of the foldable easel of FIG. 1.
Figure 7:
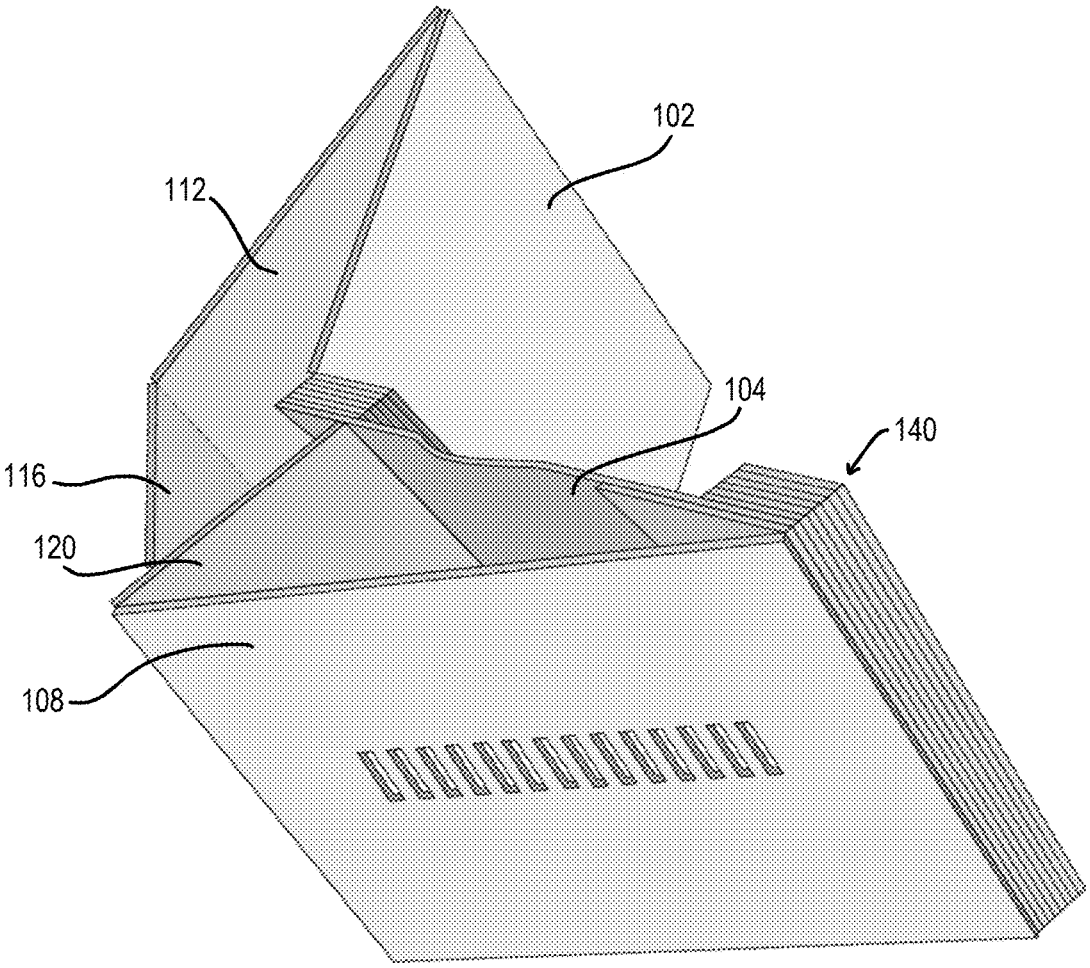
FIG. 7 is a bottom perspective view of the foldable easel of FIG. 1.

With continued reference to FIGS. 1-8, and as best seen in FIGS. 3-6, a first support panel 112 can be hingedly connected to the first panel 102 (e.g., via hinge 114) and a locking panel 116 can be hingedly connected to the first support panel 112 (e.g., via hinge 118). As shown, the first support panel 112 can be configured to stand in a fourth plane in the erected state and the locking panel 116 can be configured to stand in a fifth plane in the erected state. The fourth plane and fifth plane can be different from each other, and different from each of the first, second, and third planes. In the erected state, the locking panel 116 can be configured to lock the first panel 102 in the first plane supported by the first support panel 112. A second support panel 120 can be hingedly connected to the third panel 108 (e.g., via hinge 122). The second support panel 120 can be configured to stand in a sixth plane in the erected state, different from the previous planes. In the erected state, the second support panel 120 can be configured to interact with the locking panel 116 and the second panel 104 to lock the second panel 104 in the second plane supported by the second support panel 120, for example as best seen in FIGS. 3-5.

The second panel 104 can further include a first locking aperture 124 configured to receive a locking flap 126 of the locking panel 116 in the erected state and a second locking aperture 128 configured to receive a first locking tab 130 of the second support panel 120 in the erected state.

The second support panel 120 further includes a first locking aperture 132 configured to receive a first locking tab 133 of the locking panel 116 a second locking aperture 134 configured to receive a second locking tab 136 of the locking panel 116 in the erected state. As shown in the enlarged partial view in FIG. 5, the first support panel 112, the locking panel 116, and the second support panel 120 distribute force in a manner so as to keep the first panel 102 and second panel 104 erected when weight is placed on the first panel 102 and/or the second panel 104. For example, when the first item 103 is be placed on the locking tab 126, tab 126 is locked within the aperture 124 and it cannot move up and down, or in an out of the aperture 124. When weight from item 103 is applied to a top of the first panel 102, the weight is distributed through the first support panel 112, and the locking tab 126 is held in place by tension. In both cases, weight is distributed downward through the locking panel 116. The cross bracing of the locking panel 116 and second support panel 120 provide an unexpectedly strong support for items supported by the easel 100 (e.g., holding at least five pounds of weight when made of paperboard).

Still with reference to FIGS. 1-8, in certain embodiments the second panel 104 further includes a first thickened portion 138 adjacent to the first panel 102 in the erected state and a second thickened portion 140 adjacent the third panel 108 in the erected state. The first 138 and second thickened 140 portions can be configured to retain the second item 106 therebetween when the second item 106 is placed on the second panel 104 in the erected state (e.g., as shown in FIG. 9).

As shown, the first locking aperture 124 of the second panel 104 can be defined in the first thickened portion 138 such that in the erected state, the locking flap 126 of the locking panel extends through the first locking aperture 124, through the first thickened portion 138, and extends generally horizontally out beyond the first thickened portion 138 to create a ledge 142 configured to support a media item thereon, which in certain embodiments can be the same or different from the first item 103 thereon.

The second locking aperture 128 of the second panel 104 can be defined below the first thickened portion 138 such that in the erected state, the first locking tab 130 of the second support panel 120 extends through the second locking aperture 128 and along the first thickened portion 138. In certain embodiments, the first and/or second thickened portions can include at least one bore 148 for receiving a third item therein.

Figure 8:
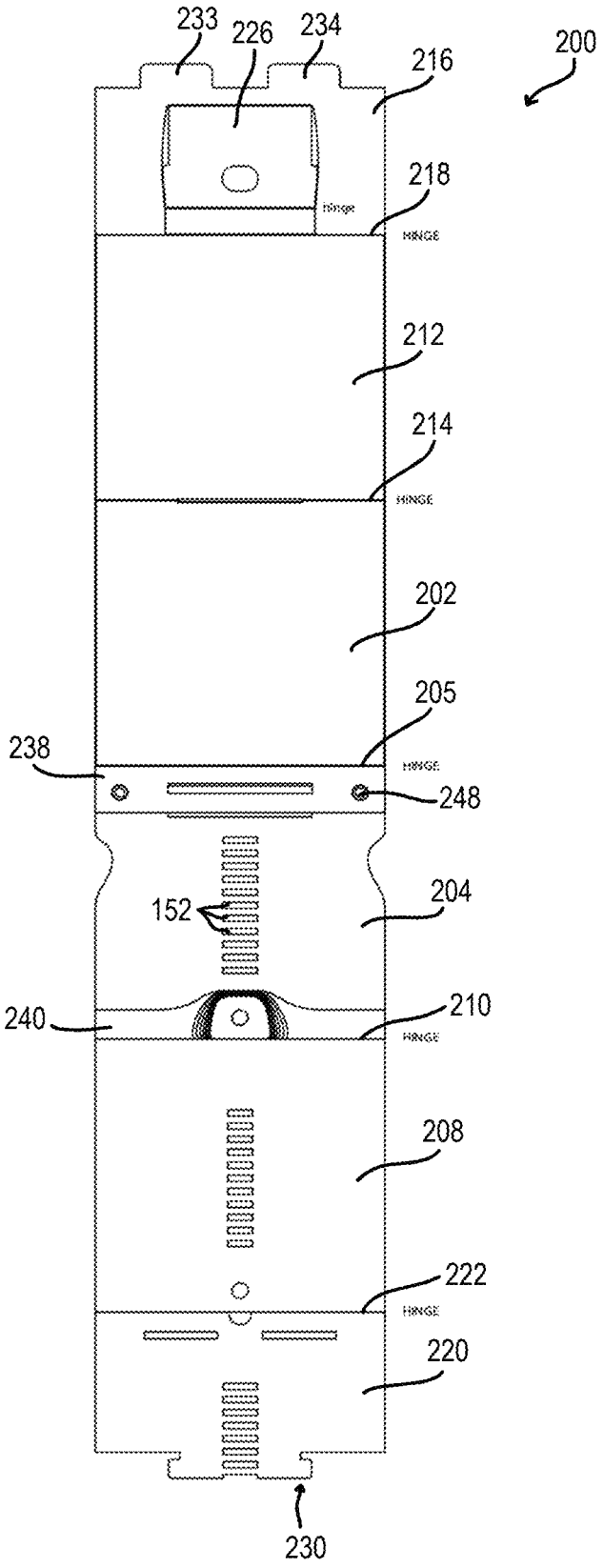
FIG. 8. is a plan view of an embodiment of a blank in accordance with this disclosure, the blank configured to fold into a foldable easel.

Now with reference to FIG. 8, in accordance with at least one aspect of this disclosure, a blank 200 for forming a foldable easel (e.g., foldable easel 100) is shown. The blank includes a locking panel 216, a first support panel 212 hingedly connected to the locking panel 216 at a first fold line 218, and a first media panel 202 hingedly connected to the first support panel 212 at a second fold line 214 opposite the first fold line 218 across the first support panel 212. When set up the first media panel 202 can be configured to support a first medium 103, e.g., as described above. A second media panel 204 can be hingedly connected to a first panel 202 at a third fold line 205 opposite the second fold 214 line across the first media panel 202. The second media panel 204 can include a first 238 and second thickened portion 240 with at least one bore 248 defined therein. When set up, the second media panel 204 can be configured to support a second medium 106, e.g., as described above.

A third panel 208 can be hingedly connected to the second panel 204 at a fourth fold line 210 opposite the third fold line 205 across the second media panel 204, and a second support panel 220 can be hingedly connected to the third panel 208 at a fifth fold line 222 opposite the fourth fold line 210 across the third panel 208.

When the easel 100 is set up, the third panel 208 can be configured to lay flat on a horizontal surface. To fold the blank 200 into the easel 100 as shown in FIG. 9, starting with the blank facing down, the second media panel 204 can be folded upward and away from the third panel 208 to form a first viewing plane 304. The second support panel 220 can be folded upward and away from the third panel 208 to meet the second media panel 204. A locking tab portion 230 of the second support panel 220 can be configured to insert into the second media panel 204 to lock the second media panel 204 in the first viewing plane 304. The first media panel 202 can folded relative to the second media panel 204 to stand generally vertically relative to the horizontal third panel 208 to form a second viewing plane 302. The first support panel 212 can be folded downward, away from the first media panel 202 and towards the third panel 208, and the locking panel 216 can be folded relative to the first support panel 212 inwards towards the third panel 208.

A first portion (e.g., locking tabs 233 and 234) of the locking panel 216 can be inserted into the second support panel 220 to lock the first support panel 212 and the first media panel 202 into place. A second portion (e.g., locking flap 226) of the locking panel 216 can be inserted into the second panel 204 to lock the first media panel 202 into place and further support the first medium 103 on the first media panel 202. When the easel is folded (e.g., in a state of non-use), the locking panel 216, the first support panel 212, the first media panel 202, the second media panel 204, the third panel 208, and the second support panel 220 are configured to lay flat and stack atop one another, e.g., as shown in FIG. 11.

With specific reference to FIGS. 9-12, in certain embodiments the first item 103 can be a book 903, configured to hang over the hinge between 114 the first panel 102 and the first support panel 112. As shown, the book 903 can be a spiralized book, such as a calendar. The second item 106 can be a writing pad 906 configured to be held on the second panel 104 between the first thickened portion 138 and the second thickened portion 140. The first and second thickened portions 138, 140 can be configured to restrict up and down movement of the writing pad 906 during use. For example, the second item 106 will rest between the first 138 and second thickened portion 140 of the second panel 104 such that it may be stabilized when it is being worked on and the item will not move. In certain embodiments, e.g., as shown in FIGS. 9-12, the second item 106 can be a notebook 906, such as a spiralized notebook, and the second panel 104 can further include a plurality of apertures 152 configured to receive a spiral binding 954 of the spiralized notebook 906 such that the pages of the spiral notebook 906 lay flat on the second panel 104.

Figure 13:
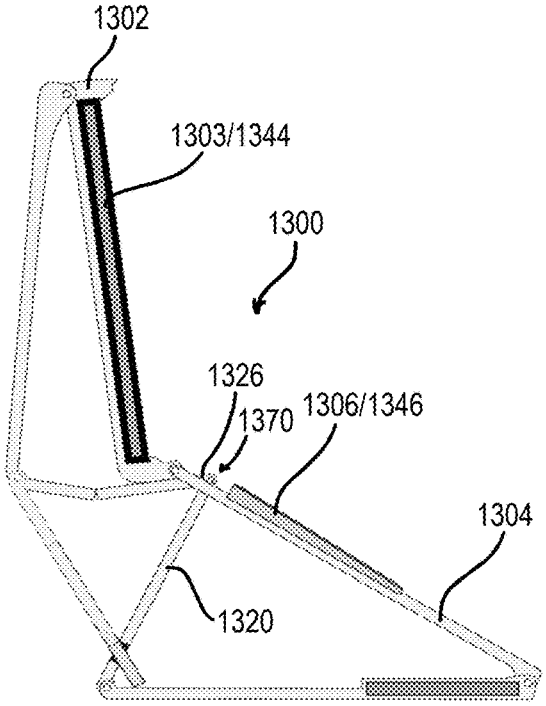
FIG. 13 is a side elevation view of an embodiment of another foldable easel in accordance with this disclosure, showing the foldable easel in an erected state with a first and second item supported thereon.
Figure 15:
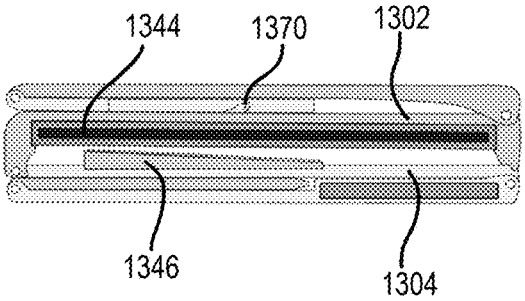
FIG. 15 is a side elevation view of the foldable easel of FIG. 13, showing the easel in a folded state.
Figure 14:
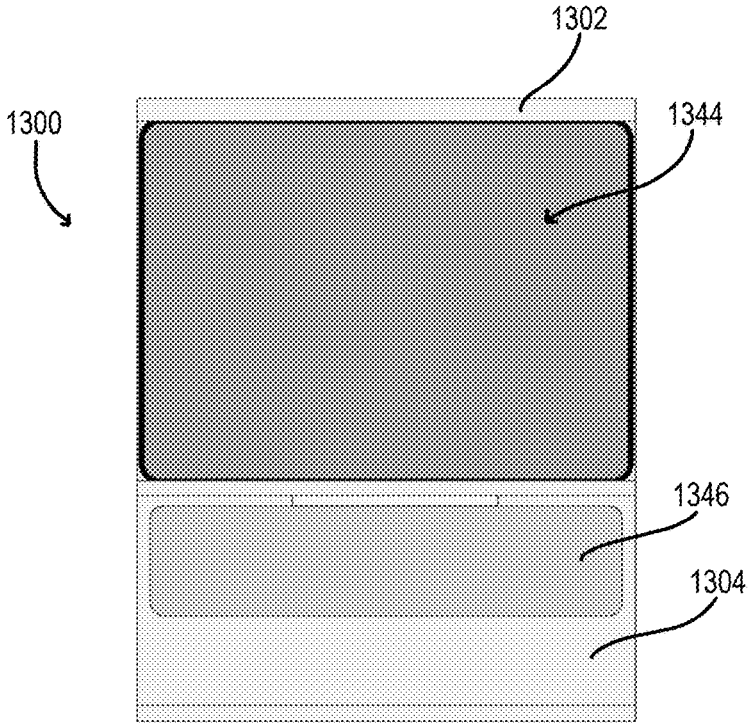
FIG. 14 is a front elevation view of the foldable easel of FIG. 13.

Turning now to FIGS. 13-15, another embodiment of a foldable easel 1300 is shown. The foldable easel 1300 can have the same or similar components and/or can be constructed in the same or similar manner as described above with respect to foldable easel 100 and blank 200. For brevity, the description of certain common elements that have been described above may not be repeated with respect to FIGS. 13-15. Easel 1300 is similar to easel 100, except that for easel 1300, the locking tab 1326 can have a hook portion 1370 configured to hook onto the second support panel 1320 outside of the second panel 1304. Additionally, while easel 100 may be made of board (e.g., paper, paperboard, or corrugated board), easel 1300 can be made of plastic or metal, where the hinges connecting each panel are hinge pins, rather than fold lines. Also as shown, in certain embodiments the first item 103 can be a viewing screen 1344 (e.g., a tablet or iPad) configured to rest within the first panel 1302 in the erected state, and the second item 106 can be a keyboard 1346 configured to be held on the second panel. In this case, the first and second items 1303, 1306 are configured to communicate with one another. As shown in this example, the foldable easel 1300 allows for a user to type on the keyboard 1346 while working on the viewing screen 1344. The relative angles of the first and second panels 1304, 1304 provide for a more comfortable viewing/work experience for the user. FIG. 14 shows a head on view of the easel 1300, and FIG. 15 shows the easel 1300 in a folded state. The foldable easel 1300 is configured and adapted to hold the first and second items, e.g., the tablet 1344 and keyboard 1346 in their respective panels even in the folded state.

Figure 16:
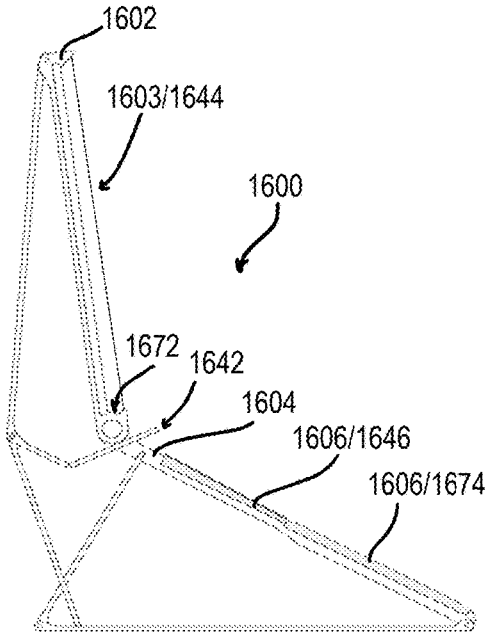
FIG. 16 is a side elevation view of an embodiment of another foldable easel in accordance with this disclosure, showing the foldable easel in an erected state with a first and second item supported thereon.
Figure 18:
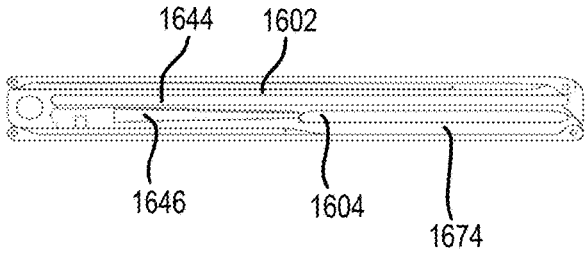
FIG. 18 is a side elevation view of the foldable easel of FIG. 16, showing the easel in a folded state.
Figure 17:
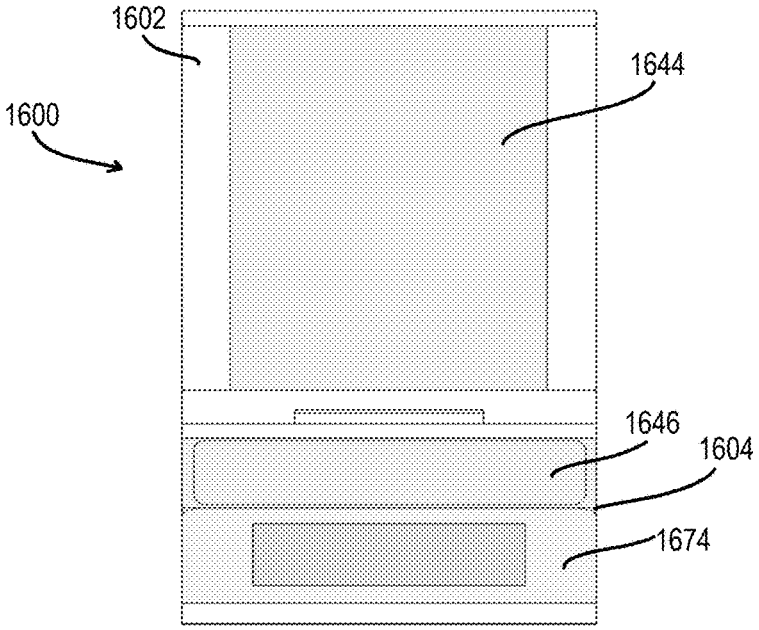
FIG. 17 is a front elevation view of the foldable easel of FIG. 16.

Turning now to FIGS. 16-18, another embodiment of a foldable easel 1600 is shown. The foldable easel 1600 can have the same or similar components and/or can be constructed in the same or similar manner as described above with respect to foldable easel 100, 1300 and blank 200. For brevity, the description of certain common elements that have been described above may not be repeated with respect to FIGS. 16-18. The easel 1600 is similar to both the easel 100 and 1300. The easel 1600 can be made of plastic or metal, and have at least some hinges with hinge pins, like easel 1300, but may have some hinges more similar to easel 100. Also, the easel 1600 can have a ledge 1642 extending through the second panel 1604 more like easel 100.

Different from easels 100 and 1300, easel 1600 can have a plurality of defined sections for holding multiple different items on each of the first and second panels 1602, 1604. For example, the first panel 1602 can have a slot 1672 for holding the first item 1603, and the second panel 1604 can have two defined portions for holding multiple second items 1606. In this example, the first item 1603 can be a viewing screen 1644, one of the second items 1606 can be a keyboard 1646 and one of the second items 1606 can be a graphics/drawing tablet 1674, both the keyboard 1646 and graphics/drawing tablet 1674 configured to communicate with the viewing screen 1646, where the user can seamlessly transition between the items. The second panel 1604 can be shaped to conform to the second item(s) 1606 to prevent movement of the items 1606 when in use (e.g., to prevent the items 1606 from falling off the easel 1600 or moving out of their desired position). FIG. 17 shows a head on view of the easel 1600 having the viewing screen 1644, the keyboard 1646, and the drawing tablet 1674 thereon.

Disclosed herein are embodiments of a self-supporting foldable easel which can be easily erected, folded, and/or disassembled in no more than three steps. In certain embodiments the easel may be made of corrugated cardboard, gator board, paper board, plastic, composite material, or another equivalent material. In certain embodiments the material used may be biodegradable.

In certain embodiments the locking flap 126 has a hinge 170 to make it flexible when going into the locking aperture of the second panel 104. The locking flap 126 helps distribute the weight of the upper portion of the easel by pushing the upper portion of the easel 100 slightly down and backwards which in turn puts upward tension on the ledge 142 of the locking flap 126. To release the locking flap 126, slight pressure should be applied to the locking panel 116 and the first support panel 112. This provides an unexpected strength to the easel compared to conventional easels, which rely entirely on the hinge to support the weight of items placed on the upright panel causing the hinges to weaken and fail prematurely.

Embodiments of the easel disclosed herein can be easily folded and unfolded for portability and for easy storage. The easel, starting from a folded position, folds out, first by lifting the top section, hinged in the front, upwards revealing a hidden panel hinged at the back. This panel lifts up and slots into the panel above creating a triangular structure which serves as the base and the lower easel. The remaining layers, also hinged at the back, swing upward to form the upper easel. The upper section, consisting of three panels, folds out. The first two panels are the front and back of the upper easel. The third panel splits into two tabs. One-tab slots into the lower section of the base and one tab slots into the upper section of the base, forming the shelf of the upper easel and the assembly is complete.

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the apparatus and methods of the subject disclosure have been shown and described, those skilled in the art will readily appreciate that changes and/or modifications may be made thereto without departing from the scope of the subject disclosure.

What is claimed is:

1. A foldable easel configured to move between a folded state and an erected state comprising:

a first panel configured to stand in a first plane in an erected state and configured to support a first item, a second panel hingedly connected to the first panel configured to stand in a second plane different from the first plane in the erected state and configured to support a second item;

a third panel hingedly connected to the second panel, configured to stand in a third plane in the erected state, the third plane different from the first plane and the second plane, wherein the third panel is configured to lay flat on a horizontal surface in the erected state, and wherein, in the erected state, the second panel is angled less than 90 degrees relative to the third panel, and the first panel is angled greater than 90 degrees relative to the second panel, and wherein in a folded state, the first panel, the second panel, and the third panel are all parallel;

a first support panel hingedly connected to the first panel; a locking panel hingedly connected to the first support panel, the first support panel configured to stand in a fourth plane in the erected state and the locking panel configured to stand in a fifth plane in the erected state, wherein, in the erected state, the locking panel is configured to lock the first panel in the first plane supported by the first support panel;

a second support panel hingedly connected to the third panel, the second support panel configured to stand in a sixth plane in the erected state, wherein, in the erected state, the second support panel is configured to interact with the locking panel and the second panel to lock the second panel in the second plane supported by the second support panel;

a first locking aperture defined in the second panel configured to receive a locking flap of the locking panel in the erected state; and a second locking aperture defined in the second panel configured to receive a first locking tab of the second support panel in the erected state, wherein the second support panel further includes a third locking aperture configured to receive a first locking tab of the locking panel in the erected state, and wherein the second support panel further includes a fourth locking aperture configured to receive a second locking tab of the locking panel, in the erected state.

2. The foldable easel of claim 1, wherein the second panel further comprises a first thickened portion adjacent the first panel in the erected state and a second thickened portion adjacent the third panel in the erected state, wherein the first and second thickened portions are configured to retain the second item therebetween when the second item is placed on the second panel in the erected state.

3. The foldable easel of claim 2, wherein the first locking aperture of the second panel is defined in the first thickened portion such that in the erected state, the locking flap of the locking panel extends through the first locking aperture, through the first thickened portion, and extends out beyond the first thickened portion to create a ledge, and wherein the second locking aperture of the second panel is defined below the first thickened portion such that in the erected state, the first locking tab of the second support panel extends through the second locking aperture and along the first thickened portion.

4. The foldable easel of claim 3, wherein in the folded state, the first panel, the second panel, the third panel, the first support panel, the locking panel, and the second support panel are configured to lie parallel to one another.

5. The foldable easel of claim 3, wherein the locking flap of the locking panel is configured to extend through the first thickened portion generally horizontally such that the locking flap of the locking panel is configured to support the first item thereon.

6. The foldable easel of claim 5, wherein the first item is a viewing screen configured to rest on the first locking flap in the erected state, wherein the second item is a graphics tablet configured to be held on the second panel between the first thickened portion and the second thickened portion to restrict up and down movement of the graphics tablet.

7. The foldable easel of claim 5, wherein at least one of the first thickened portion and/or the second thickened portion of the second panel further includes a bore for receiving a third item, wherein the third item is a pen or stylus.

8. The foldable easel of claim 5, wherein the first item is a book configured to hang over a hinge between the first panel and the first support panel, and wherein the second item is writing pad configured to be held on the second panel between the first thickened portion and the second thickened portion to restrict up and down movement of the writing pad such that a user can utilize the writing pad at an ergonomic angle while viewing the book at an ergonomic angle.

9. The foldable easel of claim 5, wherein the second item is a spiralized notebook, and wherein the second panel further comprises a plurality of apertures configured to receive a spiral of the spiralized notebook such that the spiral notebook is configured to lay flat on the second panel.

10. A foldable easel comprising:

a first panel standing in a first viewing plane, a second panel hingedly connected to the first panel and standing in a second viewing plane different from the first plane;

a third panel hingedly connected to the second panel and standing in a third plane, the third plane different from the first plane and the second plane, wherein, in a state of use, the third panel is configured to lay flat on a horizontal surface, and wherein, the second panel is angled less than 90 degrees relative to the third panel, and the first panel is angled greater than 90 degrees relative to the second panel, wherein in a state of non-use the first panel, the second panel, and the third panel are configured to fold together to be parallel to one another;

a first support panel hingedly connected to the first panel and a locking panel hingedly connected to the first support panel, the first support panel standing in a fourth plane and the locking panel standing in a fifth plane;

one or more locking features configured to lock the first panel in the first plane supported by the first support panel; and a second support panel hingedly connected to the third panel, the second support panel standing in a sixth plane, wherein, the second support panel is configured to interact with the locking panel and the second panel to lock the second panel in the second plane supported by the second support panel, wherein the one or more locking features includes a first locking aperture and a second locking aperture of the second panel, and a third locking aperture and a fourth locking aperture of the second support panel.

11. The foldable easel of claim 10, wherein the first panel is configured to support a first item, and the second panel is configured to support a second item, and wherein the first item is a viewing screen configured to rest on a first locking flap in the erected state, wherein the second item is a graphics tablet configured to be held on the second panel between a first thickened portion and a second thickened portion to restrict up and down movement of the graphics tablet.

12. The foldable easel of claim 10, wherein at least one of a first thickened portion and/or a second thickened portion of the second panel further includes a bore for receiving a pen or a stylus.

13. The foldable easel of claim 10, wherein the first panel is configured to support a first item, and the second panel is configured to support a second item, and wherein the first item is a book configured to hang over a hinge between the first panel and a first support panel, and wherein the second item is writing pad configured to be held on the second panel between a first thickened portion and a second thickened portion to restrict up and down movement of the writing pad such that a user can utilize the writing pad at an ergonomic angle while viewing the book at an ergonomic angle.

14. The foldable easel of claim 10, wherein the second panel is configured to support a spiralized notebook, and wherein the second panel further comprises a plurality of apertures configured to receive a spiral of the spiralized notebook such that the spiral notebook is configured to lay flat on the second panel.

15. A blank for forming a foldable easel, comprising:

a locking panel;

a first support panel hingedly connected to the locking panel at a first fold line;

a first media panel hingedly connected to the first support panel at a second fold line opposite the first fold line across the first support panel, wherein in a set up easel the first media panel is configured to support a first medium;

a second media panel hingedly connected to the first panel at a third fold line opposite the second fold line across the first media panel comprising a first and second thickened portion with at least two bores, wherein in the set-up easel the second media panel is configured to support a second medium;

a third panel hingedly connected to the second panel at a fourth fold line, opposite the third fold line across the second media panel; and a second support panel hingedly connected to the third panel at a fifth fold line, opposite the fourth fold line across the third panel;

wherein in the set-up easel:

the third panel is configured to lay flat on a horizontal surface;

the second media panel is configured to fold upward and away from the third panel to form a first viewing plane;

the second support panel is configured to fold upward and away from the third panel to meet the second media panel, wherein a locking tab portion of the second support panel is configured to insert into the second media panel to lock the second media panel in the first viewing plane;

the first media panel is configured to fold relative to the second media panel to stand generally vertically relative to the horizontal to form a second viewing plane;

the first support panel is configured fold downward, away from the first media panel and towards the third panel; and the locking panel is configured to fold relative to the first support panel inwards towards the third panel, wherein a first portion of the locking panel is configured to insert into the second support panel to lock the first support panel and the first media panel into place, and a second portion of the locking panel is configured to insert into the first media panel to lock the first media panel into place and further support the first medium on the first media panel, wherein in a folded easel, the locking panel, the first support panel, the first media panel, the second media panel, the third panel, and the second support panel are configured to lay flat and stack atop one another.

16. A foldable easel comprising:

a first panel standing in a first viewing plane, a second panel hingedly connected to the first panel and standing in a second viewing plane different from the first plane; and a third panel hingedly connected to the second panel and standing in a third plane, the third plane different from the first plane and the second plane, wherein, in a state of use, the third panel is configured to lay flat on a horizontal surface, and wherein, the second panel is angled less than 90 degrees relative to the third panel, and the first panel is angled greater than 90 degrees relative to the second panel, wherein in a state of non-use the first panel, the second panel, and the third panel are configured to fold together to be parallel to one another, wherein the first panel is configured to support a first item, and the second panel is configured to support a second item, and wherein the first item is a viewing screen configured to rest on a first locking flap in the erected state, wherein the second item is a graphics tablet configured to be held on the second panel between a first thickened portion and a second thickened portion to restrict up and down movement of the graphics tablet.

17. A foldable easel comprising:

a first panel standing in a first viewing plane, a second panel hingedly connected to the first panel and standing in a second viewing plane different from the first plane; and a third panel hingedly connected to the second panel and standing in a third plane, the third plane different from the first plane and the second plane, wherein, in a state of use, the third panel is configured to lay flat on a horizontal surface, and wherein, the second panel is angled less than 90 degrees relative to the third panel, and the first panel is angled greater than 90 degrees relative to the second panel, wherein in a state of non-use the first panel, the second panel, and the third panel are configured to fold together to be parallel to one another, wherein at least one of a first thickened portion and/or a second thickened portion of the second panel further includes a bore for receiving a pen or a stylus.

18. A foldable easel comprising:

a first panel standing in a first viewing plane, a second panel hingedly connected to the first panel and standing in a second viewing plane different from the first plane; and a third panel hingedly connected to the second panel and standing in a third plane, the third plane different from the first plane and the second plane, wherein, in a state of use, the third panel is configured to lay flat on a horizontal surface, and wherein, the second panel is angled less than 90 degrees relative to the third panel, and the first panel is angled greater than 90 degrees relative to the second panel, wherein in a state of non-use the first panel, the second panel, and the third panel are configured to fold together to be parallel to one another, wherein the first panel is configured to support a first item, and the second panel is configured to support a second item, and wherein the first item is a book configured to hang over a hinge between the first panel and a first support panel, and wherein the second item is writing pad configured to be held on the second panel between a first thickened portion and a second thickened portion to restrict up and down movement of the writing pad such that a user can utilize the writing pad at an ergonomic angle while viewing the book at an ergonomic angle.

19. A foldable easel comprising:

a first panel standing in a first viewing plane, a second panel hingedly connected to the first panel and standing in a second viewing plane different from the first plane; and a third panel hingedly connected to the second panel and standing in a third plane, the third plane different from the first plane and the second plane, wherein, in a state of use, the third panel is configured to lay flat on a horizontal surface, and wherein, the second panel is angled less than 90 degrees relative to the third panel, and the first panel is angled greater than 90 degrees relative to the second panel, wherein in a state of non-use the first panel, the second panel, and the third panel are configured to fold together to be parallel to one another, wherein the second panel is configured to support a spiralized notebook, and wherein the second panel further comprises a plurality of apertures configured to receive a spiral of the spiralized notebook such that the spiral notebook is configured to lay flat on the second panel.

* * * * *